US006206811B1

(12) United States Patent
Lat

(10) Patent No.: US 6,206,811 B1
(45) Date of Patent: Mar. 27, 2001

(54) MULTI-FUNCTION EXERCISER

(76) Inventor: Shu-Chtung Lat, No. 57-15, An-Lin Rd., Hsin-Tun Dist., Taichung City (TW)

( * ) Notice: Subject to any disclaimer, the term of this patent is extended or adjusted under 35 U.S.C. 154(b) by 0 days.

(21) Appl. No.: 09/450,830

(22) Filed: Nov. 29, 1999

(51) Int. Cl.[7] ..... A63B 21/02

(52) U.S. Cl. ..... 482/126; 482/121; 482/128; 482/124

(58) Field of Search ..... 482/128, 125, 482/126, 122, 121, 124, 51, 54, 57, 127, 148

(56) References Cited

U.S. PATENT DOCUMENTS

| | | | | |
|---|---|---|---|---|
| 5,160,304 | * | 11/1992 | Van Der Hoeven | 482/128 |
| 5,637,066 | * | 6/1997 | Chang | 482/126 |
| 5,651,755 | * | 7/1997 | Chen | 482/128 |
| 5,700,232 | * | 12/1997 | Clausen et al. | 482/125 |
| 5,746,686 | * | 5/1998 | Berman et al. | 482/126 |
| 5,749,815 | * | 5/1998 | Lipps | 482/122 |
| 6,110,082 | * | 8/2000 | Tsai | 482/121 |

* cited by examiner

*Primary Examiner*—Jerome Donnelly
(74) *Attorney, Agent, or Firm*—Christie, Parker & Hale, LLP

(57) ABSTRACT

An exerciser includes two elongated barrel members, two force-bearing members, two elastic units, and a barrel-connecting member. Each barrel member is formed with an insert hole, a longitudinally extending slide channel, a longitudinal slit that extends parallel to and that permits access to the slide channel, and an anchoring block disposed adjacent to one end of the slide channel. Each force-bearing member has a slidable block portion disposed in and slidable along the slide channel of a respective barrel member, and a force-bearing portion extending laterally from the slidable block portion and out of the slide channel of the respective barrel member via the longitudinal slit. Each elastic unit is disposed in the slide channel of a respective barrel member, and has one end connected to the anchoring block of the respective barrel member, and an opposite end connected to the slidable block portion that is disposed in the slide channel of the respective barrel member. The barrel-connecting member has a pair of insert posts, each being inserted into the insert hole in the respective barrel member, thereby interconnecting the barrel members.

13 Claims, 14 Drawing Sheets

MULTI-FUNCTION EXERCISER

BACKGROUND OF THE INVENTION

1. Field of the Invention The invention relates to an exerciser, more particularly to an exerciser for training the abdominal part, arms and legs of the user.

2. Description of the Related Art

Referring to FIG. 1, a conventional abdominal exerciser is shown to include a main body 10 having two lateral wing portions 11 for hand gripping purposes. The main body 10 is formed with an accommodating space 12 that opens at a rear side of the main body 10. A force-bearing member 13 has a front end that extends slidably into the accommodating space 12. The rear side of the main body 10 is formed with a pair of stop projections 121 at the open end of the accommodating space 12 to prevent removal of the force-bearing member 13 from the accommodating space 12. A spring 14 is disposed inside the accommodating space 12, and biases the force-bearing member 13 outwardly of the accommodating space 12.

In use, the rear end of the force-bearing member 13 is pressed against the abdominal part of the user, while the hands of the user grip the lateral wing portions 11 of the main body 10. The user then pulls the main body 10 toward him against the action of the spring 14, followed by a subsequent release action that causes the main body 10 to revert to its initial state due to the expanding action of the spring 14. By repeating the pulling and releasing actions on the main body 10, training of the abdominal part of the user is thus achieved.

Because both hands of the user are required to grip the lateral wing portions 11 of the main body 10 when the aforesaid abdominal exerciser is in use, the exercise effect to the arms of the user is limited. In addition, the abdominal exerciser is not suited for exercising other parts of the human body.

SUMMARY OF THE INVENTION

Therefore, the object of the present invention is to provide an exerciser that can be used to train the abdominal part, arms and legs of the user.

According to this invention, an exerciser comprises a pair of elongated barrel members, a pair of force-bearing members, a pair of elastic units, and a barrel-connecting member.

Each of the barrel members is formed with an insert hole, a longitudinally extending slide channel, a longitudinal slit that extends parallel to and that permits access to the slide channel, and an anchoring block that is disposed adjacent to one end of the slide channel.

Each of the force-bearing members has a slidable block portion that is disposed in and that is slidable along the slide channel of a respective one of the barrel members, and a force-bearing portion that extends laterally from the slidable block portion and out of the slide channel of the respective one of the barrel members via the longitudinal slit.

Each of the elastic units is disposed in the slide channel of a respective one of the barrel members, and has one end connected to the anchoring block of the respective one of the barrel members, and an opposite end connected to the slidable block portion of the force-bearing member that is disposed in the slide channel of the respective one of the barrel members. Each of the elastic units provides resistance to movement of the slidable block portion of the respective one of the force-bearing members along the slide channel of the respective one of the barrel members.

The barrel-connecting member has a pair of insert posts, each of which is inserted into the insert hole in the respective one of the barrel members, thereby interconnecting the barrel members.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
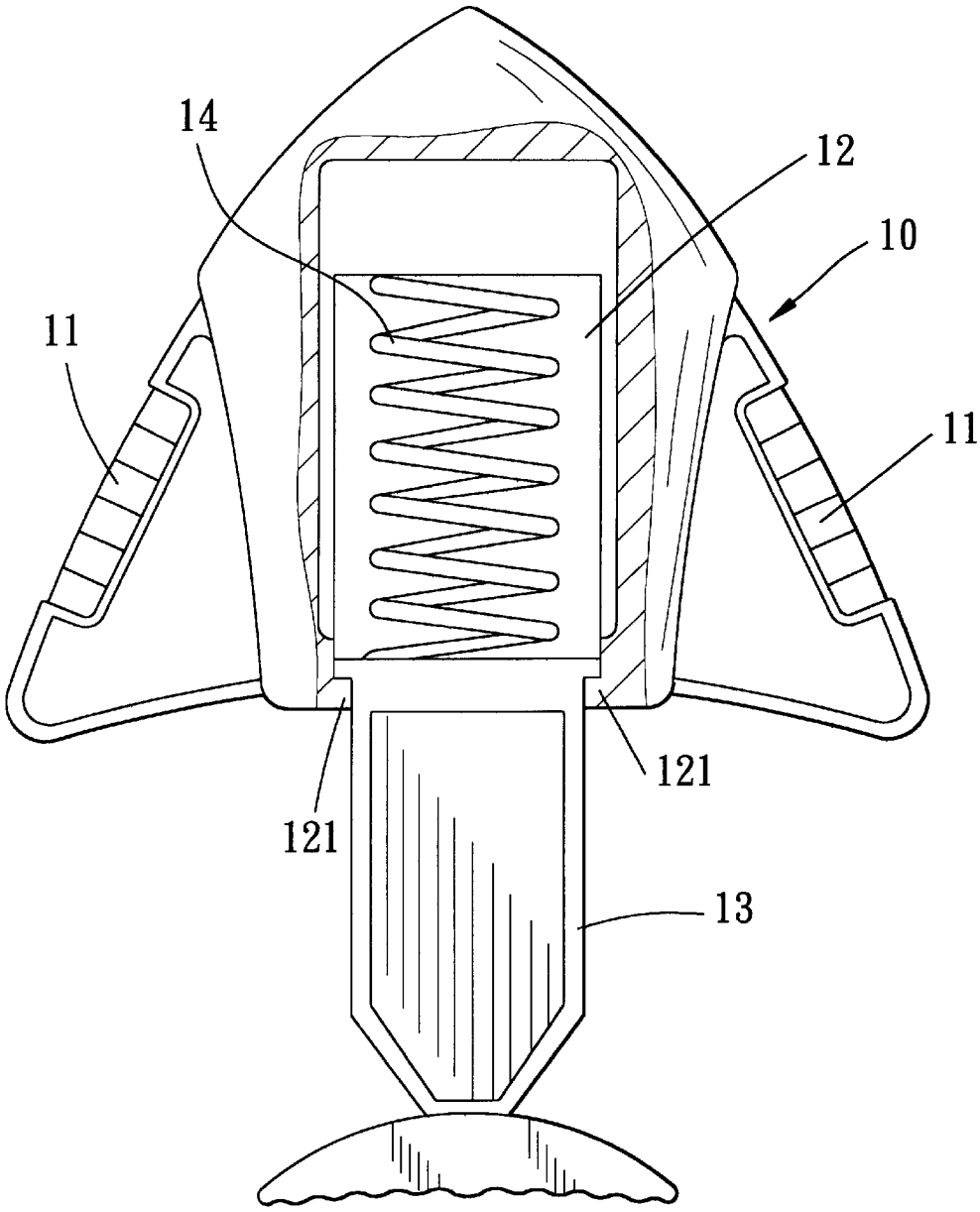
FIG. 1 PRIOR ART
FIG. 1 is a schematic, partly sectional view of a conventional abdominal exerciser.

Before the present invention is described in greater detail, it should be noted that like elements are denoted by the same reference numerals throughout the disclosure.

Figure 2:
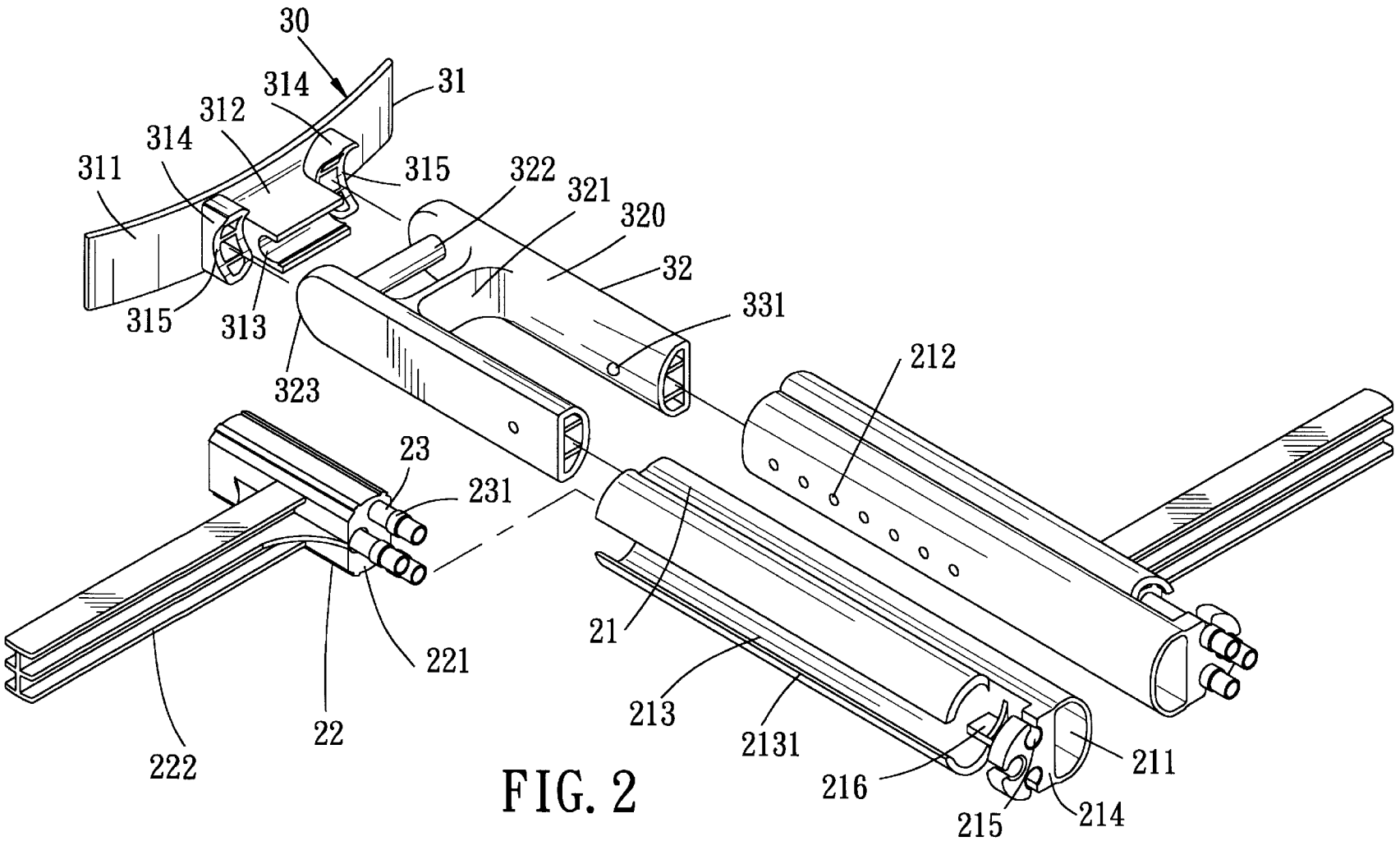
FIG. 2 is an exploded perspective view of the first preferred embodiment of an exerciser according to the present invention.
Figure 3:
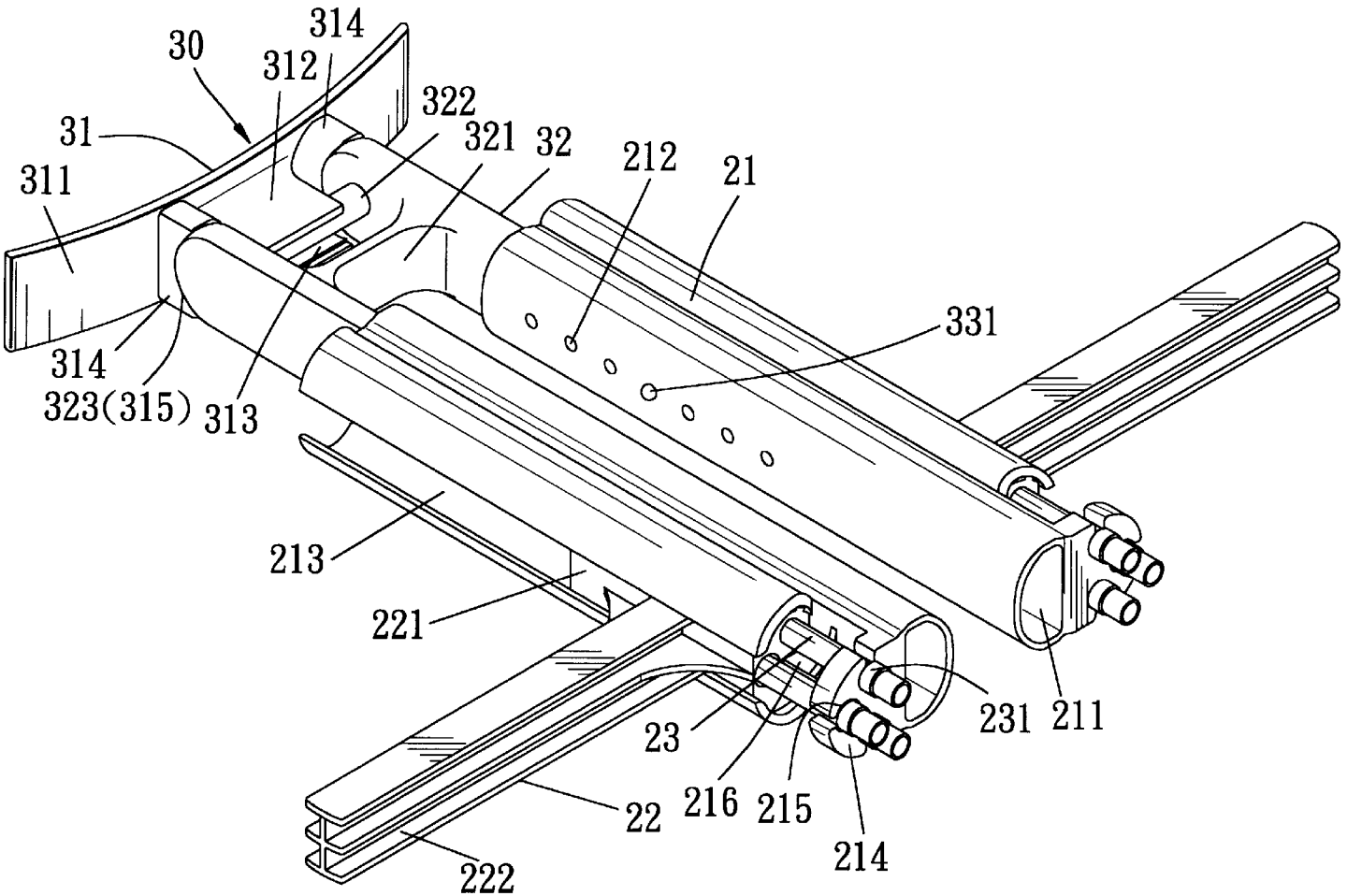
FIG. 3 is an assembled perspective view of the first preferred embodiment.
Figure 4:
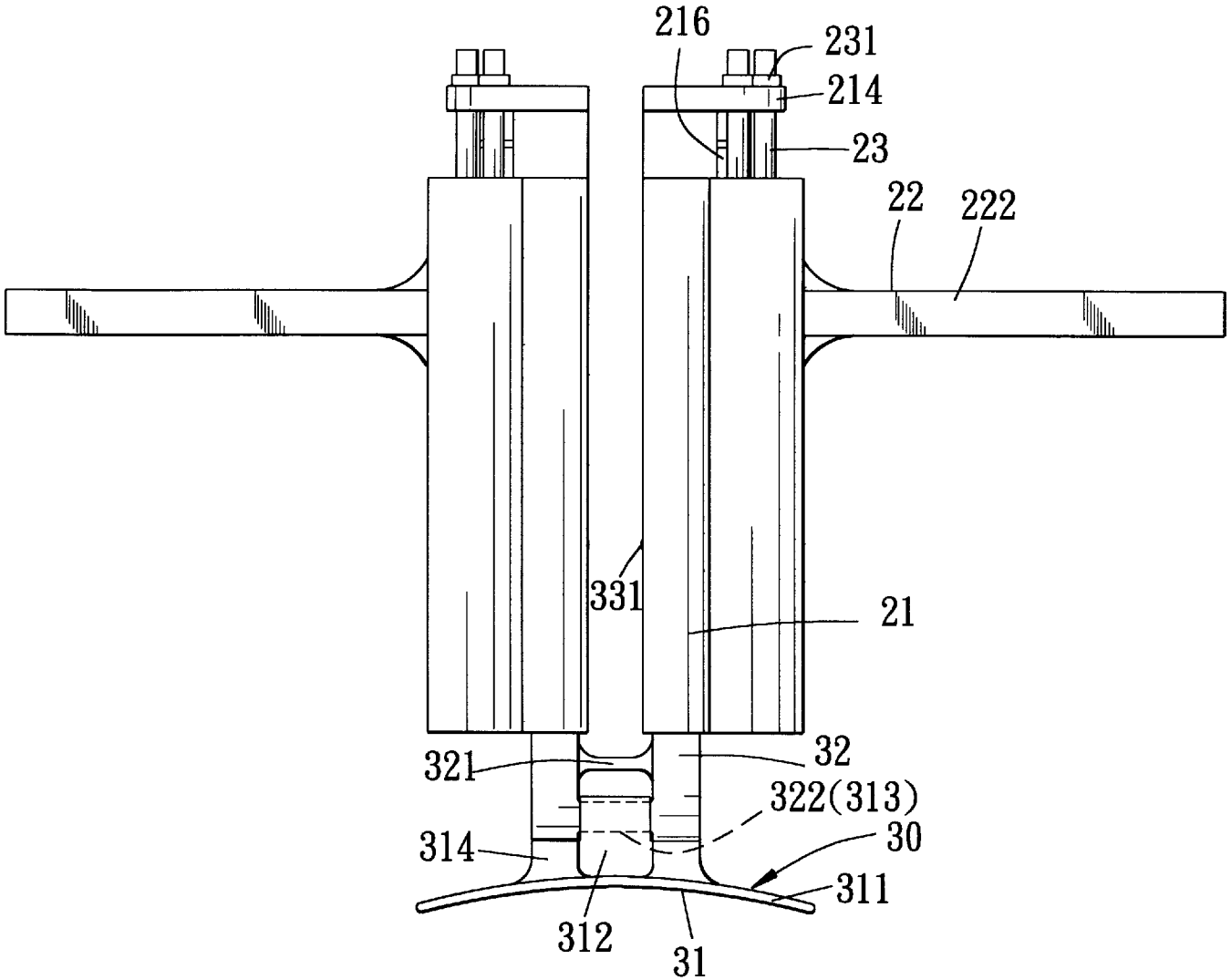
FIG. 4 is a schematic view of the first preferred embodiment.

Referring to FIGS. 2, 3 and 4, the first preferred embodiment of an exerciser according to the present invention is shown to comprise a pair of elongated barrel members 21, a pair of force-bearing members 22, and a barrel-connecting member 30.

Each of the barrel members 21 is formed with a longitudinally extending insert hole 211 therethrough, and a plurality of positioning holes 212 that are aligned along an axis of the insert hole 211 and that are communicated with the insert hole 211. Each of the barrel members 21 is further formed with a longitudinally extending slide channel 213 that extends parallel to the insert hole 211, and a longitudinal slit 2131 that extends parallel to and that permits access to the slide channel 213 Each of the barrel members 21 is further formed with an anchoring block 214 adjacent to one end of the slide channel 213, and a limit block 216 that projects into the slide channel 213 and that is disposed proximate to the anchoring block 214. In this embodiment, the anchoring block 214 has a peripheral portion formed with three retaining notches 215.

Each of the force-bearing members 22 has a slidable block portion 220 that is disposed in and that is slidable along the slide channel 213 of a respective one of the barrel members 21, and a force-bearing portion 222 that extends laterally from the slidable block portion 220 and out of the slide channel 213 of the respective one of the barrel members 21 via the longitudinal slit 2131. The limit block 216 limits movement of the slidable block portion 220 of the respective force-bearing member 22 in the slide channel 213 so as to prevent impact with the anchoring block 214 of the respective barrel member 21. In this embodiment, the force-bearing portion 222 is formed as a straight member that extends integrally from the slidable block portion 220 in a direction transverse to the slide channel 213, and that is adapted for gripping by a human hand.

Figure 5:
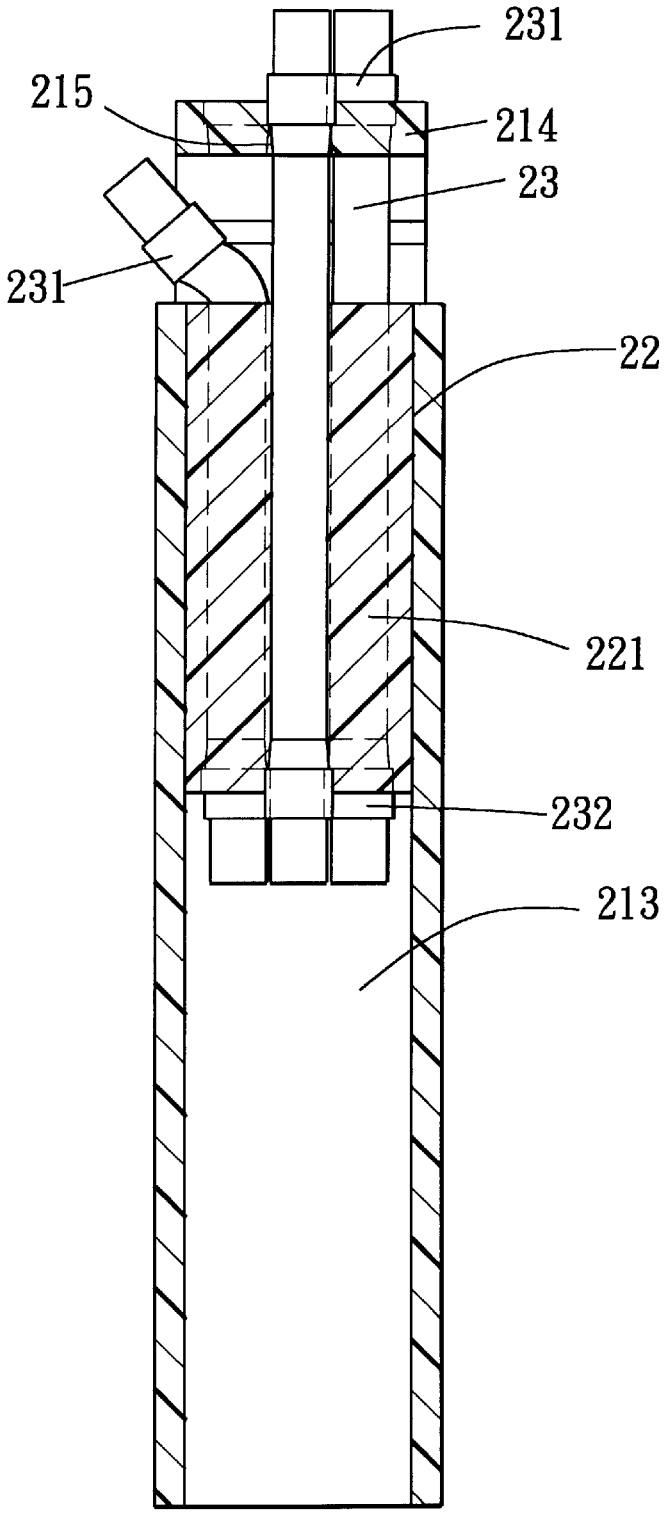
FIG. 5 is a sectional view illustrating the connection between a barrel member and a force-bearing member of the first preferred embodiment.

With further reference to FIG. 5, an elastic unit connects the slidable block portion 220 of each force-bearing member 22 to the anchoring block 214 of the respective barrel member 21. In this embodiment, the elastic unit includes three elastic cord members 23. Each cord member 23, such as a rubber cord, has a head end portion 231 that extends toward the anchoring block 214 for engaging removably one of the retaining notches 215, and a tail end portion 232 that extends through the slidable block portion 220 and that is secured to the latter. The cord members 23 provide resistance to movement of the slidable block portion 220 along the slide channel 213 in a direction away from the anchoring block 214 when the force-bearing portion 222 is operated. To adjust the resistance to such movement of the slidable block portion 220, the head end portion 231 of each of the cord members 23 can be selectively and easily disengaged from the respective retaining notch 215 in the anchoring block 214, thereby achieving a variable exercising effect.

Referring again to FIGS. 2, 3 and 4, in this embodiment, the barrel-connecting member 30 includes an abdominal contact portion 31 and an insert portion 32 separable from the abdominal contact portion 31. The abdominal contact portion 31 includes a curved contact plate 311 having one side adapted to be placed in contact with a human abdominal part, and an opposite side formed with a fastening seat 312. The fastening seat 312 is formed with an elongate pivot groove 313. The pivot groove 313 is defined by a rounded groove wall having an arc length that is greater than 180°. A pair of pivot supports 314 are formed on the opposite side of the contact plate 311 and are disposed adjacent to opposite ends of the pivot groove 313, respectively. Each of the pivot supports 314 has a concave support face 315. The insert portion 32 includes a parallel pair of insert posts 320 that are interconnected by a transverse rib 321. Each of the insert posts 320 has a proximate portion disposed proximate to the contact plate 311, and a distal portion inserted removably into the insert hole 211 in a respective one of the barrel members 21. The proximate portions of the insert posts 320 are interconnected by a transverse pivot shaft 322 that is retained fittingly and pivotally in the pivot groove 313 of the fastening seat 312. The proximate portions of the insert posts 320 further have convex end faces 323 for sliding contact with the convex support faces 315 on the pivot supports 314. The insert portion 32 is thus pivotable relative to the abdominal contact portion 31.

Figure 6:
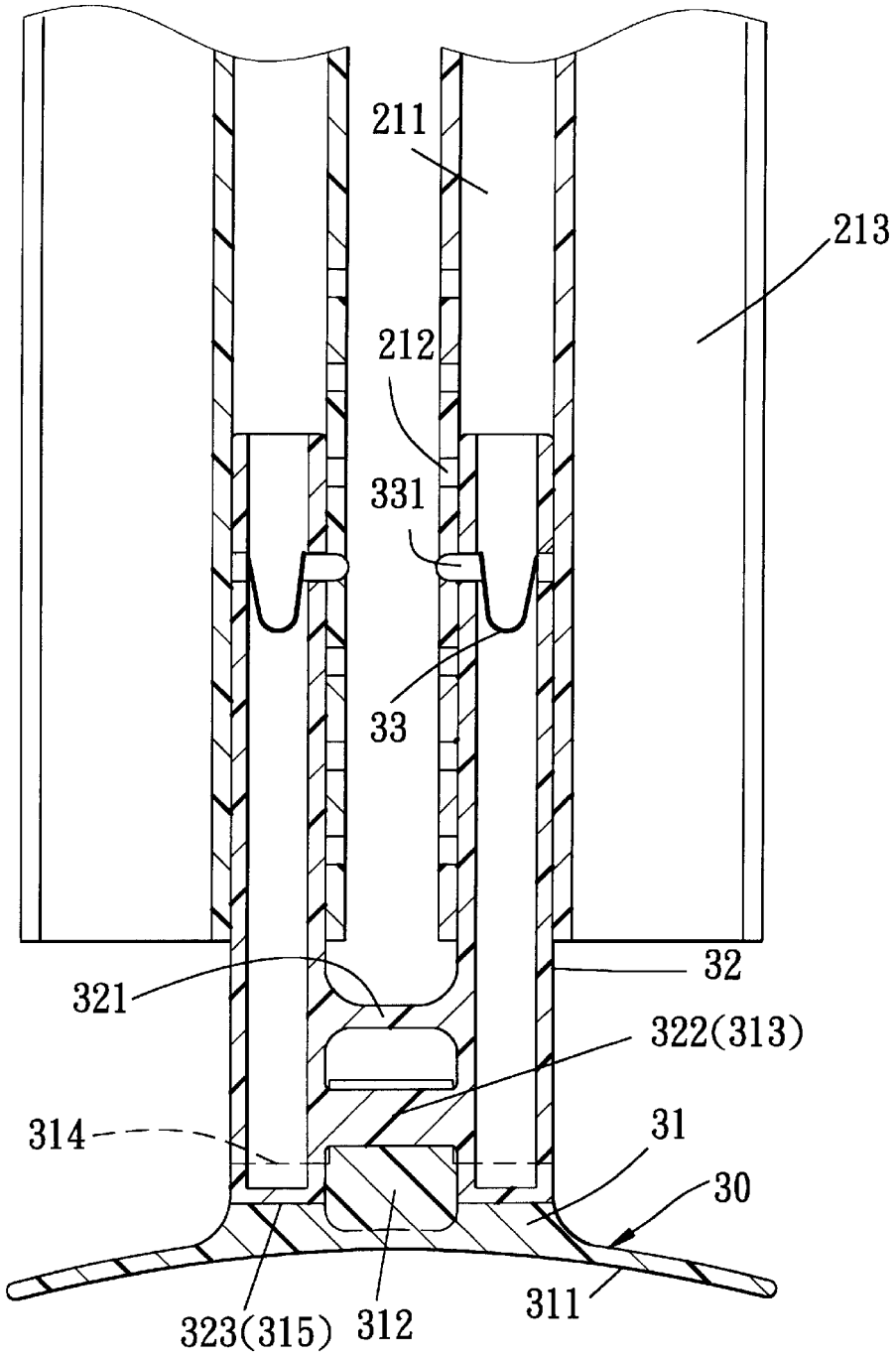
FIG. 6 is a fragmentary sectional view illustrating the connection between two barrel members and a barrel-connecting member of the first preferred embodiment.

With further reference to FIG. 6, the distal portion of each of the insert posts 320 has a U-shaped spring 33 mounted therein. One end of the spring 33 is secured to the insert post 320. The other end of the spring 33 is connected to a retainer 331 that projects radially and outwardly from the insert post 320. When the insert post 320 is inserted into the insert hole 211 in the respective barrel member 21, the retainer 331 is capable of engaging releasably an aligned one of the positioning holes 212 in the respective barrel member 21, thereby enabling adjustment of the distance between the anchoring block 214 on the barrel member 21 and the contact plate 311 to suit the length of the arms of the user.

Figure 7:
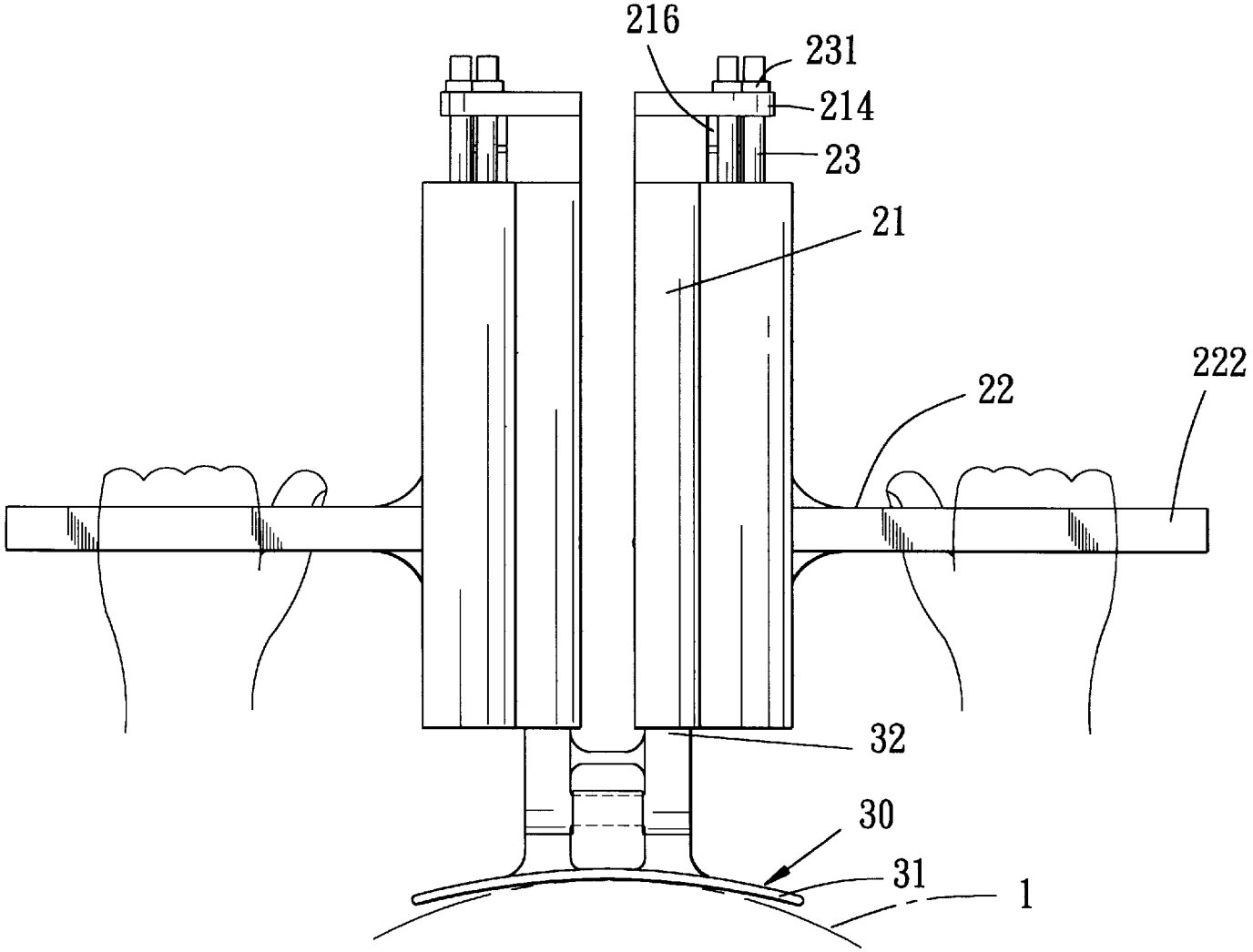
FIG. 7 is a schematic view illustrating the first preferred embodiment in a state of use.
Figure 8:
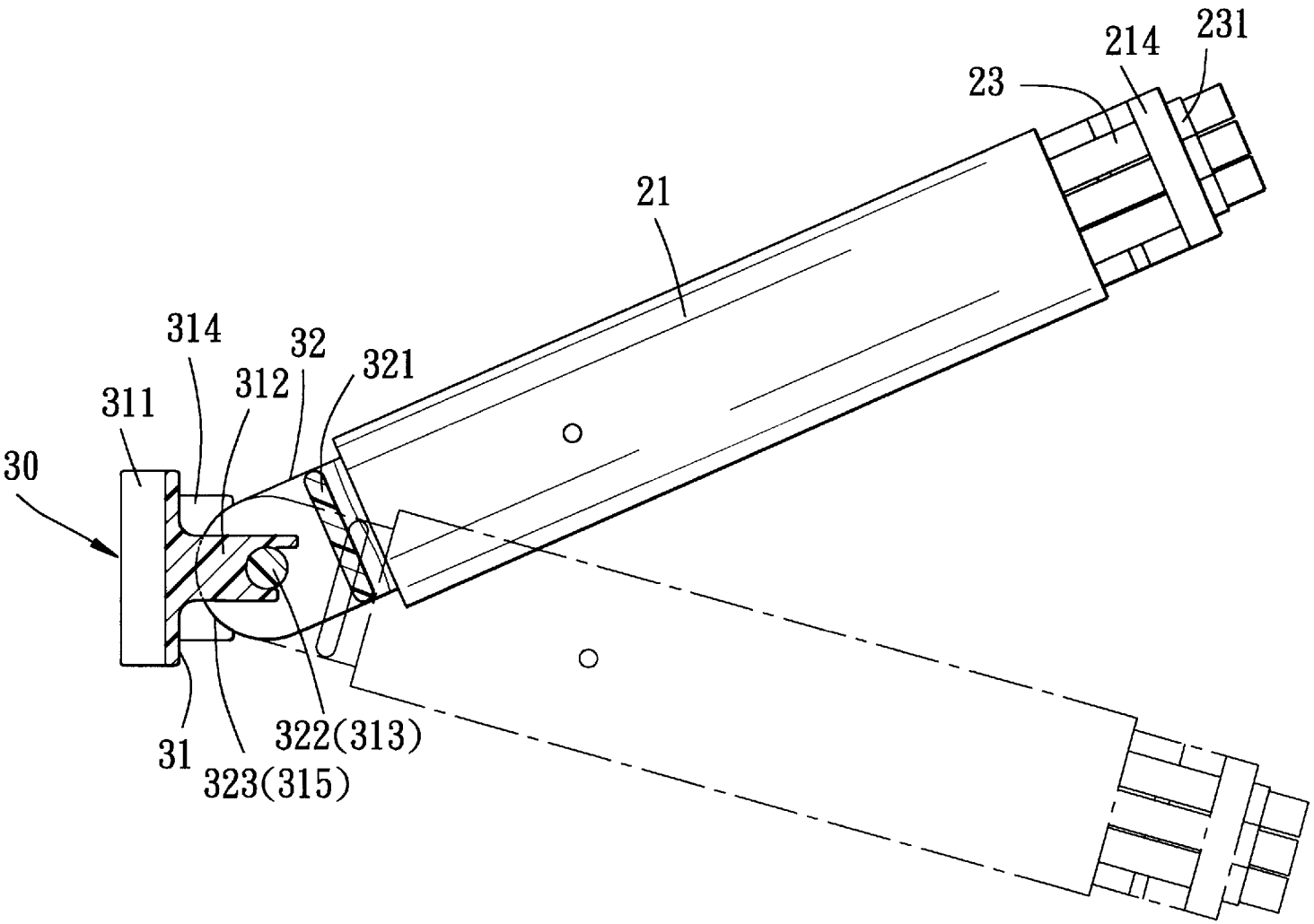
FIG. 8 is a schematic, partly sectional view illustrating the first preferred embodiment in another state of use.

Referring to FIG. 7, in use, the contact plate 311 is pressed against the abdominal part 1 of the user, while the hands of the user grip the force-bearing portions 222 of the force-bearing members 22. The user then pulls the force-bearing members 22 toward him against the action of the cord members 23, followed by a subsequent release action that causes the force-bearing members 22 to revert to their initial positions due to the contracting action of the cord members 23. By repeating the pulling and releasing actions on the force-bearing members 22, training of the abdominal part 1 of the user is thus achieved. Because the force-bearing members 22 are disposed on separate barrel members 21, the force-bearing members 22 can be operated independently of the other for individual training of the arms of the user. As shown in FIG. 8, since the insert portion 32 is pivotable relative to the abdominal contact portion 31, the position of the barrel members 21 relative to the abdominal contact portion 31 can be adjusted as deemed comfortable by the user.

Figure 9:
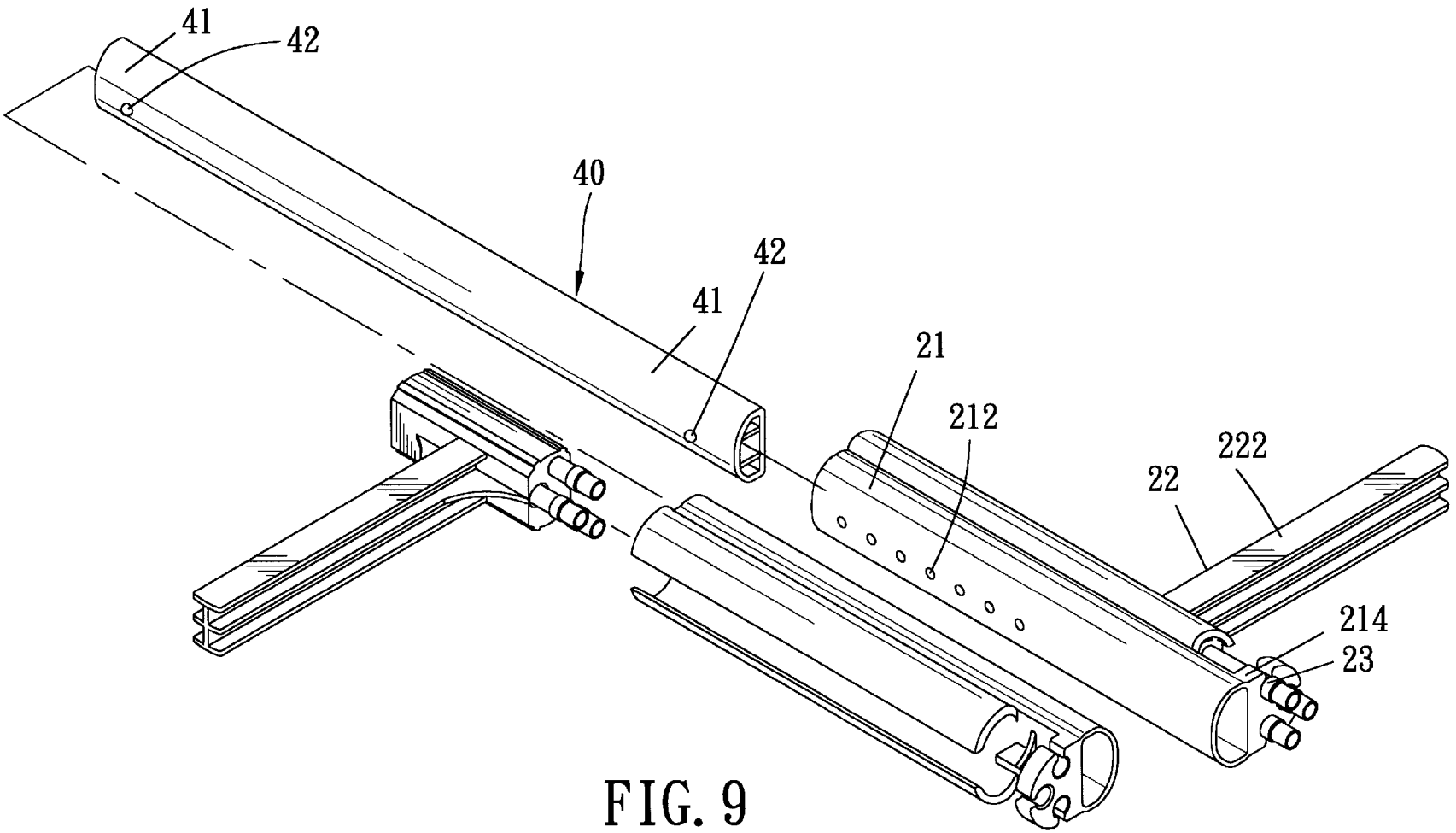
FIG. 9 is an exploded perspective view of the second preferred embodiment of an exerciser according to the present invention.

FIG. 9 illustrates the second preferred embodiment of an exerciser according to the present invention. The main difference between the exerciser of this embodiment and that of the previous embodiment resides in the construction of the barrel-connecting member 40. As shown, the barrel-connecting member 40 of the second preferred embodiment is formed as an elongated bar having two end portions that serve as insert posts 41 and that are disposed coaxial with each other. The insert posts 41 are inserted removably and respectively into the insert holes 211 in the barrel members 21, and are provided with a respective spring-loaded retainer 42, similar to that found in the insert posts of the previous embodiment, for engaging releasably an aligned one of the positioning holes 212 in the respective barrel member 21.

Figure 10:
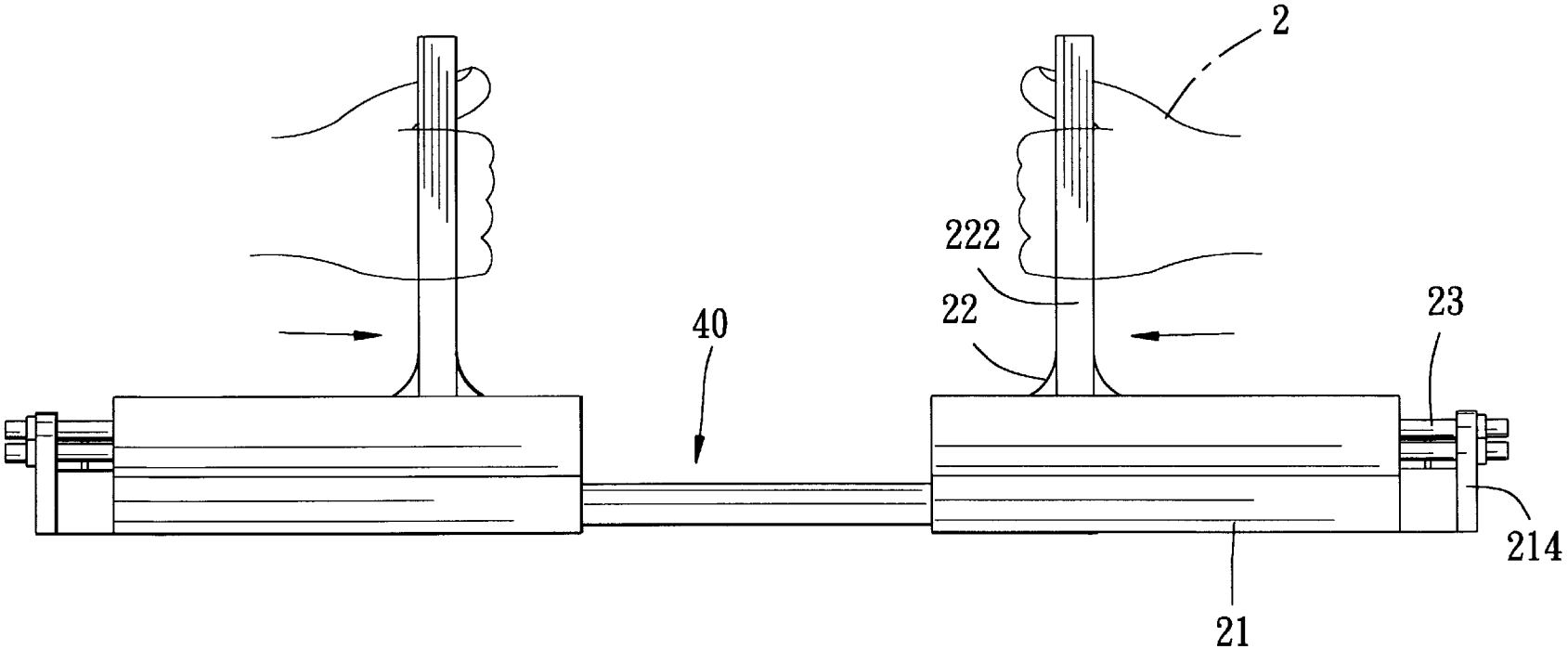
FIG. 10 is a schematic view illustrating the second preferred embodiment in a first state of use.
Figure 11:
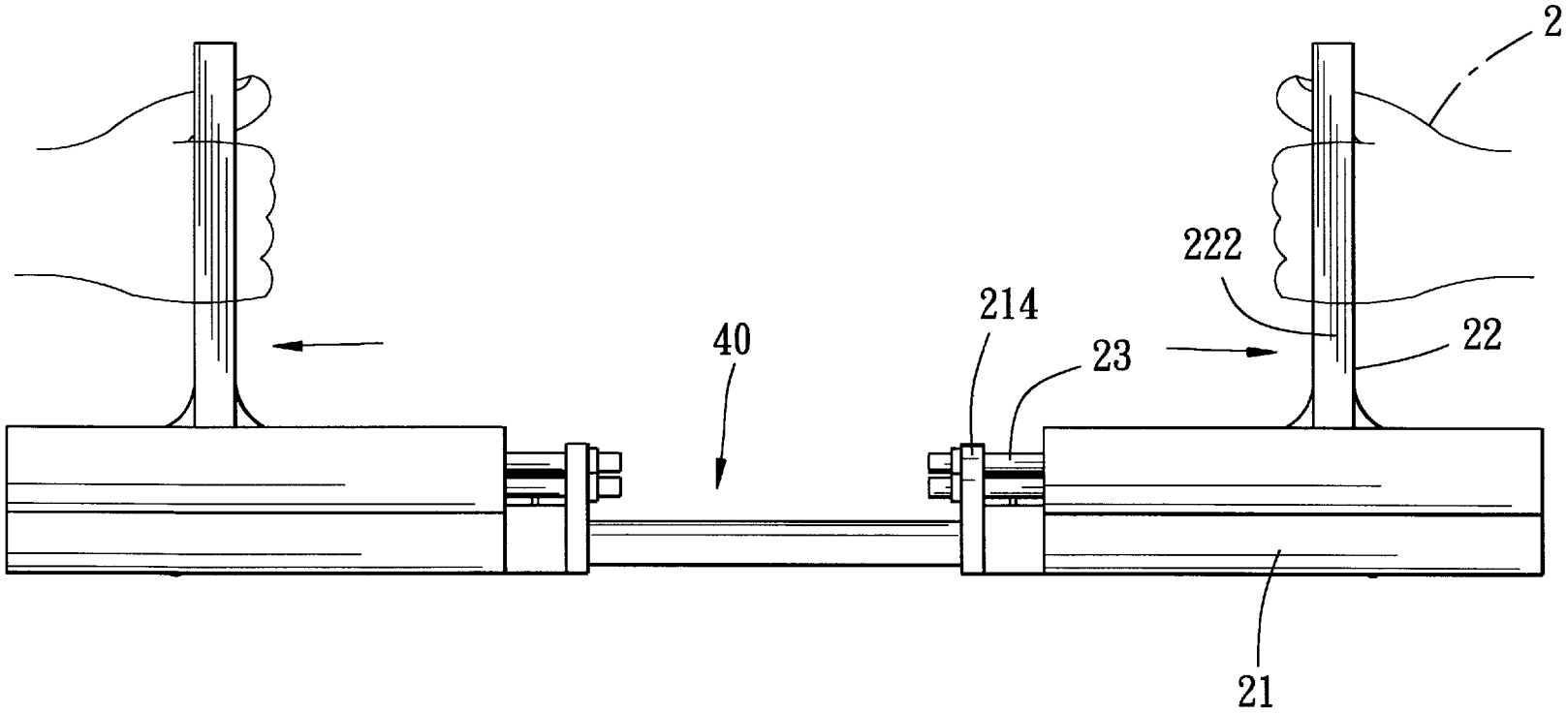
FIG. 11 is a schematic view illustrating the second preferred embodiment in a second state of use.

Referring to FIG. 10, when the barrel-connecting member 40 interconnects the barrel members 21 such that the anchoring blocks 214 face away from each other, the hands 2 of the user can operate the force-bearing members 22 for movement toward each other against the action of the cord members 23. As shown in FIG. 11, when the barrel-connecting member 40 interconnects the barrel members 21 such that the anchoring blocks 214 face toward each other, the hands 2 of the user can operate the force-bearing members 22 for movement away from each other against the action of the cord members 23. The exerciser of the second preferred embodiment can thus be used to train the arms 2 of the user via repeated pulling or pushing actions.

Figure 12:
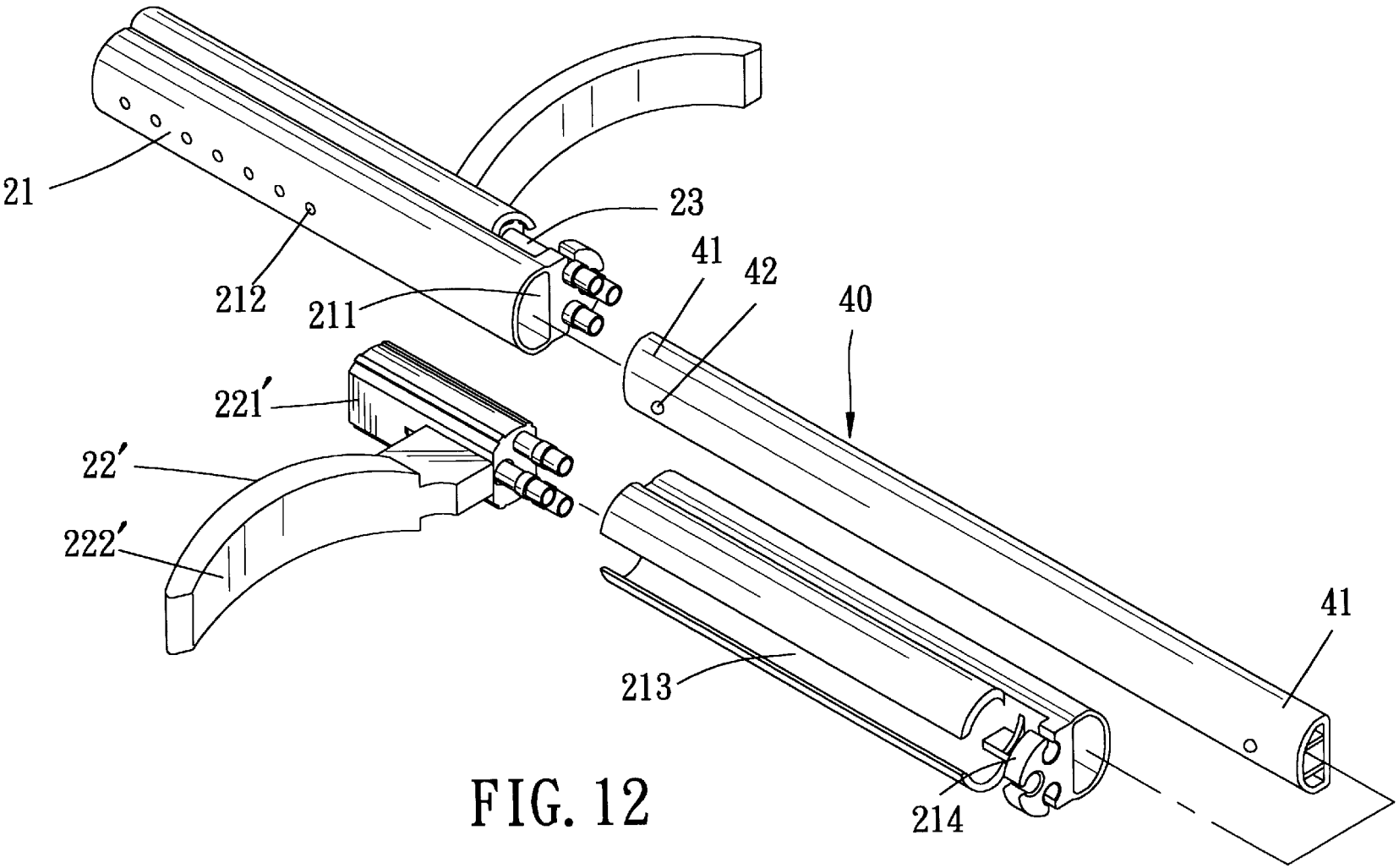
FIG. 12 is an exploded perspective view of the third preferred embodiment of an exerciser according to the present invention.

FIG. 12 illustrates the third preferred embodiment of an exerciser according to the present invention. The main difference between the exerciser of this embodiment and that of the second preferred embodiment resides in the construction of the force-bearing members 22'. As shown, the force-bearing portions 222' of the force-bearing members 22' are generally curved to conform with the contour of a human leg.

Figure 13:
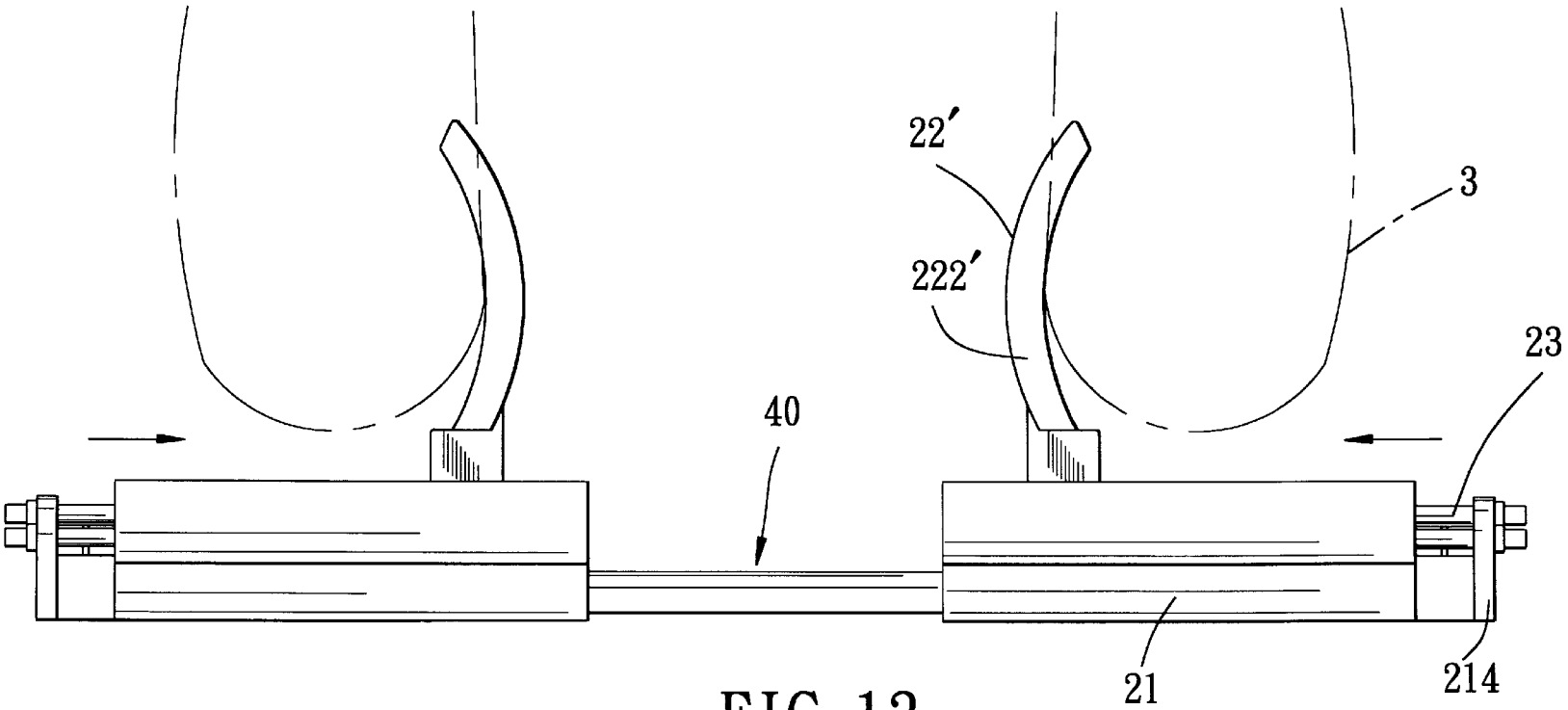
FIG. 13 is a schematic view illustrating the third preferred embodiment in a first state of use.
Figure 14:
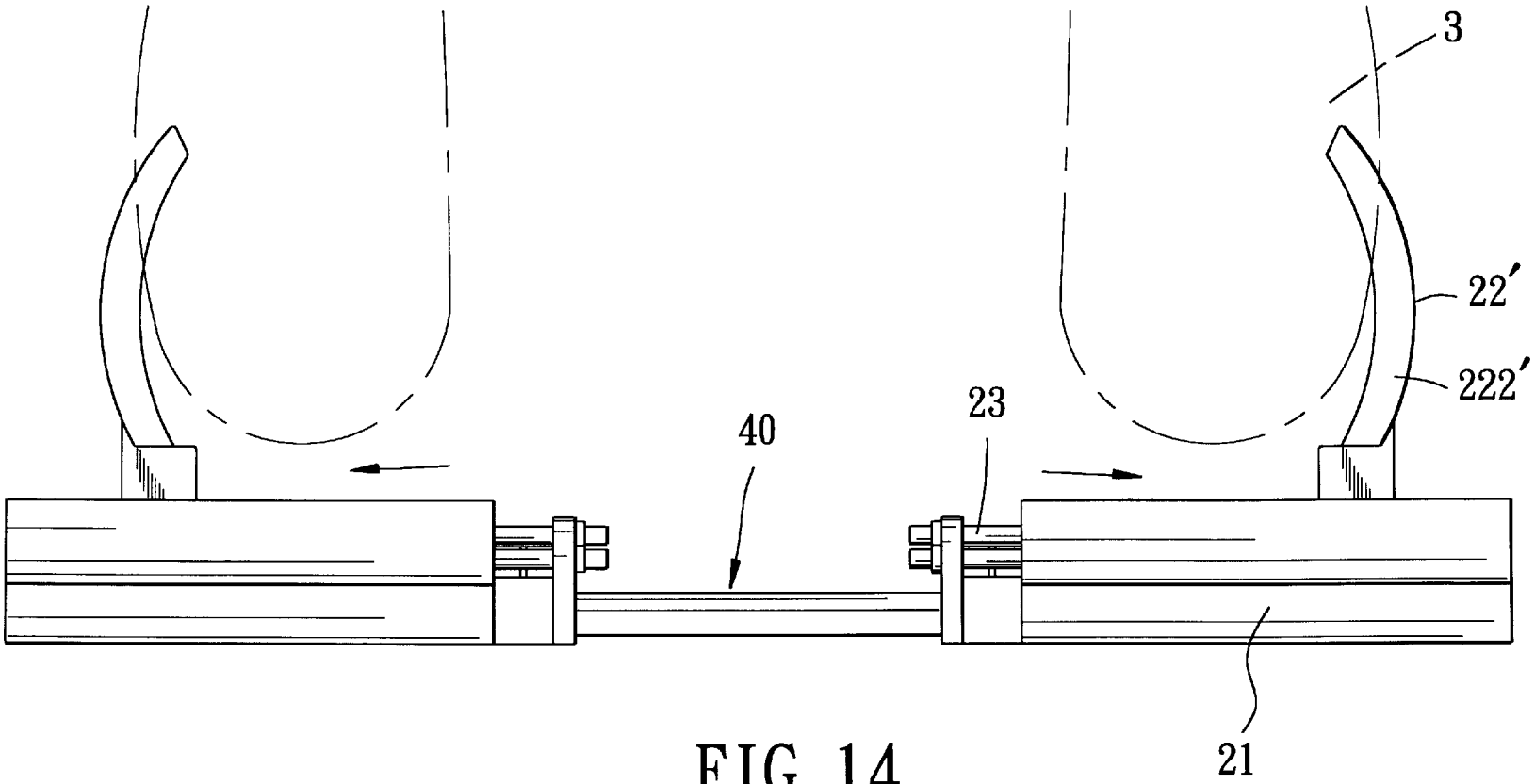
FIG. 14 is a schematic view illustrating the third preferred embodiment in a second state of use.

Referring to FIG. 13, when the barrel-connecting member 40 interconnects the barrel members 21 such that the anchoring blocks 214 face away from each other, the force-bearing portions 222' of the force-bearing members 22' are disposed to contact inner sides of the legs 3 of the user, and the user can force the force-bearing members 22' to move toward each other against the action of the cord members 23. As shown in FIG. 14, when the barrel-connecting member 40 interconnects the barrel members 21 such that the anchoring blocks 214 face toward each other, the force-bearing portions 222' of the force-bearing members 22' are disposed to contact outer sides of the legs 3 of the user, and the user can force the force-bearing members 22' to move away from each other against the action of the cord members 23. The exerciser of the third preferred embodiment can thus be used to train the legs of the user via repeated pressing or spreading actions.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An exerciser comprising:

a pair of elongated barrel members, each of which is formed with an insert hole, a longitudinally extending slide channel, a longitudinal slit that extends parallel to and that permits access to said slide channel, and an anchoring block that is disposed adjacent to one end of said slide channel;

a pair of force-bearing members, each of which has a slidable block portion that is disposed in and that is slidable along said slide channel of a respective one of said barrel members, and a force-bearing portion that extends laterally from said slidable block portion and out of said slide channel of the respective one of said barrel members via said longitudinal slit;

a pair of elastic units, each of which is disposed in said slide channel of a respective one of said barrel members, and has one end connected to said anchoring block of the respective one of said barrel members, and an opposite end connected to said slidable block portion of said force-bearing member that is disposed in said slide channel of the respective one of said barrel members, each of said elastic units providing resistance to movement of said slidable block portion of the respective one of said force-bearing members along said slide channel of the respective one of said barrel members; and a barrel-connecting member having a pair of insert posts, each of which is inserted into said insert hole in the respective one of said barrel members, thereby interconnecting said barrel members.

2. The exerciser of claim 1, wherein each of said barrel members is further formed with a limit block that projects into said slide channel and that is disposed proximate to said anchoring block to limit movement of said slidable block portion of the respective one of said force-bearing members in said slide channel so as to prevent impact with said anchoring block of the respective one of said barrel members.

3. The exerciser of claim 1, wherein said insert hole extends parallel to said slide channel, each of said barrel members being further formed with a plurality of positioning holes that are aligned along an axis of said insert hole and that are communicated with said insert hole, each of said insert posts being provided with a spring-loaded retainer that projects outwardly and radially therefrom and that engages releasably an aligned one of said positioning holes in the respective one of said barrel members for retaining telescopically the respective one of said barrel members on said insert post.

4. The exerciser of claim 1, wherein said anchoring block of each of said barrel members has a peripheral portion formed with a plurality of retaining notches, each of said elastic units including a plurality of elastic cord members, each of said elastic cord members having a head end portion retained removably at one of said retaining notches in said anchoring block of the respective one of said barrel members, and a tail end portion secured to said slidable block portion of said force-bearing member that is disposed in said slide channel of the respective one of said barrel members.

5. The exerciser of claim 4, wherein each of said elastic cord members is a rubber cord.

6. The exerciser of claim 1, wherein said barrel-connecting member includes an abdominal contact portion having one side adapted to be placed against a human abdominal part, and an insert portion connected to an opposite side of said abdominal contact portion and formed with said insert posts, said insert posts being disposed parallel to each other.

7. The exerciser of claim 6, wherein said insert portion is pivotable relative to said abdominal contact portion.

8. The exerciser of claim 7, wherein said insert portion is further formed with a pivot shaft that extends transversely between and that interconnects said insert posts, said opposite side of said abdominal contact portion being formed with a fastening seat, said fastening seat being formed with a pivot groove that retains fittingly and pivotally said pivot shaft therein.

9. The exerciser of claim 8, wherein each of said insert posts has a convex end face, and said opposite side of said abdominal contact portion is further formed with a pair of pivot supports disposed respectively adjacent to opposite ends of said pivot groove, each of said pivot supports having a concave support face that contacts slidingly said convex end face on a respective one of said insert posts.

10. The exerciser of claim 8, wherein said pivot groove is defined by a rounded groove wall having an arc length that is greater than 180°.

11. The exerciser of claim 1, wherein said force-bearing portion of each of said force-bearing members is formed as a straight member that extends integrally from said slidable block portion in a direction transverse to said slide channel, and that is adapted for gripping by a human hand.

12. The exerciser of claim 1, wherein said barrel-connecting member is formed as an elongated bar having two end portions that serve as said insert posts and that are disposed coaxial with each other.

13. The exerciser of claim 1, wherein said force-bearing portion of each of said force-bearing members has a curvature that conforms to the contour of a human leg.

* * * * *